US005655505A

United States Patent [19]

Tusino

[11] Patent Number: 5,655,505

[45] Date of Patent: Aug. 12, 1997

[54] APPARATUS AND METHOD FOR IMPROVING FUEL EFFICIENCY OF GASOLINE ENGINES

[75] Inventor: Alfred J. Tusino, Kailua-Kona, Hi.

[73] Assignee: Electro-Mechanical R & D Corp., Kailua-Kona, Hi.

[21] Appl. No.: 641,427

[22] Filed: May 1, 1996

Related U.S. Application Data

[63] Continuation-in-part of Ser. No. 232,943, Apr. 22, 1994, Pat. No. 5,522,368.

[51] Int. Cl.[6] ..... F02M 17/22

[52] U.S. Cl. ..... 123/522; 123/516

[58] Field of Search ..... 123/522, 516; 137/587

[56] References Cited

U.S. PATENT DOCUMENTS

| | | | |
|---|---|---|---|
| 868,246 | 10/1907 | Bates | 123/522 |
| 2,357,947 | 9/1944 | Gerson . | |
| 3,395,681 | 8/1968 | Walker . | |
| 3,530,842 | 9/1970 | von Brimer | 123/522 |
| 3,616,779 | 11/1971 | Newkirk . | |
| 3,790,139 | 2/1974 | Stephenson et al. | 123/522 |
| 3,792,688 | 2/1974 | Grainger . | |
| 3,800,533 | 4/1974 | Zankowski . | |
| 3,800,768 | 4/1974 | Rhodes et al. | 123/522 |
| 3,931,801 | 1/1976 | Rose et al. | 123/522 |
| 4,003,356 | 1/1977 | Naylor . | |
| 4,011,847 | 3/1977 | Fertino | 123/522 |
| 4,074,666 | 2/1978 | Pierce et al. | 123/522 |
| 4,076,002 | 2/1978 | Mellquist et al. | 123/522 |
| 4,175,525 | 11/1979 | Johnson | 123/522 |
| 4,368,711 | 1/1983 | Allen | 123/522 |
| 4,409,946 | 10/1983 | Sandford . | |
| 4,450,820 | 5/1984 | Haynes . | |
| 4,454,848 | 6/1984 | Duprez . | |
| 4,476,841 | 10/1984 | Duckworth | 123/522 |
| 4,562,820 | 1/1986 | Jiminez | 123/522 |
| 4,644,925 | 2/1987 | Hoppie . | |
| 4,656,979 | 4/1987 | Hogenson . | |
| 4,681,081 | 7/1987 | LaPan | 123/522 |
| 4,688,537 | 8/1987 | Calkins . | |
| 4,736,718 | 4/1988 | Linder . | |
| 4,807,584 | 2/1989 | Davis . | |
| 4,955,351 | 9/1990 | Lewis . | |
| 4,984,554 | 1/1991 | Ariga . | |
| 5,211,890 | 5/1993 | Wentworth . | |
| 5,322,099 | 6/1994 | Langlois | 137/587 |
| 5,435,288 | 7/1995 | Schmal | 123/527 |

FOREIGN PATENT DOCUMENTS

| | | | |
|---|---|---|---|
| 8301486 | 4/1983 | WIPO | 123/575 |

OTHER PUBLICATIONS

Kirk–Othmer, "Gasoline and Other Motor Fuels", Encyclopedia of Chemical Technology, Third Edition, vol. 11, pp. 652–655, 682–685.

*Primary Examiner*—Erick R. Solis
*Attorney, Agent, or Firm*—Martin E. Hsia

[57] ABSTRACT

Apparatus for supplying air-and-gasoline vapor mixture from the ullage space in a gas tank above the gasoline therein through a safety cannister and a shut-off valve to two "gang" valve assemblies that divide the vapor into individual flows that are delivered directly to the intake valves of the individual cylinders of a piston-and-cylinder engine, by-passing the carburetor and the intake manifold. The gas tank is aerated through a vent pipe having on one end an air filter open to outside air and on the other end an aerator submerged in the gasoline, and the fuel-vapor mixture is directed into the intake ports of the intake valves by heat-resistant nozzle tubes.

19 Claims, 2 Drawing Sheets

APPARATUS AND METHOD FOR IMPROVING FUEL EFFICIENCY OF GASOLINE ENGINES

CROSS-REFERENCE TO RELATED APPLICATION

This is a continuation-in-part of application Ser. No. 08/232,943, filed Apr. 22, 1994, which is incorporated herewith by reference, now U.S. Pat. No. 5,522,368.

BACKGROUND OF THE INVENTION

This invention relates generally to internal combustion engines and more specifically to an apparatus and method for supplying the fuel-air mixture to a gasoline-powered engine.

It is well known that gasoline-powered internal combustion engines of the piston-and-cylinder type are used throughout the world in large numbers to drive various mechanisms, most notably automobiles and other vehicles. Matters of great concern are the fuel-burning efficiency, and thus economy, of such engines and the amounts of harmful emissions they introduce into the atmosphere. Accordingly, great efforts have been made to improve the operating efficiency of such engines, both for better economy and for reduced emissions.

Among the prior efforts are the apparatus disclosed in U.S. Pat. No. 4,011,487 in which air bubbles are introduced from a compressor, or drawn by engine vacuum, through a supply of gasoline and conducted directly to the carburetor or intake manifold of a gasoline engine. In a variation disclosed in U.S. Pat. No. 3,931,801, exhaust gases are bubbled through the fuel to heat and vaporize it for mixing with air at the inlet of an intake manifold. U.S. Pat. No. 3,800,768 discloses an apparatus for reducing exhaust emissions during start-up, warm-up, idling and high-speed operation, by bubbling air through the gasoline to produce a mixture that by-passes the carburetor and is directed to a fuel intake system between the carburetor and the engine. A carburetor supplies the engine at other times during normal operation.

While these and other prior approaches may have had some success in improving fuel economy and reducing emissions, none seem to have met with commercial success or to have gained general acceptance, perhaps because of their complexity, relatively high expense, or other disadvantages. The general objective of this invention is to provide a new and improved method and apparatus for use in conjunction with gasoline-powered engines to improve their fuel efficiency, the apparatus being relatively simple, inexpensive and readily adaptable for automobiles, either as original equipment or for later installation.

SUMMARY OF THE INVENTION

The present invention provides a relatively simple and inexpensive apparatus, and related method, for producing a fuel mixture of gasoline vapor and air in the fuel supply of an automobile, including the fuel tank, and by-passing the conventional fuel supply system of the engine to deliver the fuel mixture directly to the intake valve in each cylinder of the engine. The result of this novel approach is to significantly increase the fuel efficiency of the engine, correspondingly reducing the gasoline consumption in operation, and reducing exhaust emissions and resultant air pollution.

More specifically, the invention introduces a flow of air to the gas tank "ullage", the space in the gas tank above the liquid gasoline therein, draws an air-and-gasoline vapor mixture from the ullage in gaseous form and conducts this mixture through a safety reservoir interposed between the tank and the engine, and introduces the vapor mixture directly into each of the cylinders of the gasoline-powered engine through appropriate valving for dividing the flow into the requisite number of individual flows and delivering these flows to the intake valves of the respective cylinders. The valving preferably includes flow adjustment means for balancing the flows to the cylinders.

Accordingly, the invention by-passes the usual fuel supply system, whether it is a carburetor, a fuel injection device or otherwise, and delivers the vapor mixture directly to the intake valve. The result has been a dramatic improvement in fuel efficiency and emissions obtained in a conventional automobile.

Other aspects and advantages of the invention will become apparent from the following detailed description, taken in conjunction with the accompanying exemplary drawings.

DETAILED DESCRIPTION OF THE PREFERRED EMBODIMENT

Figure 1:
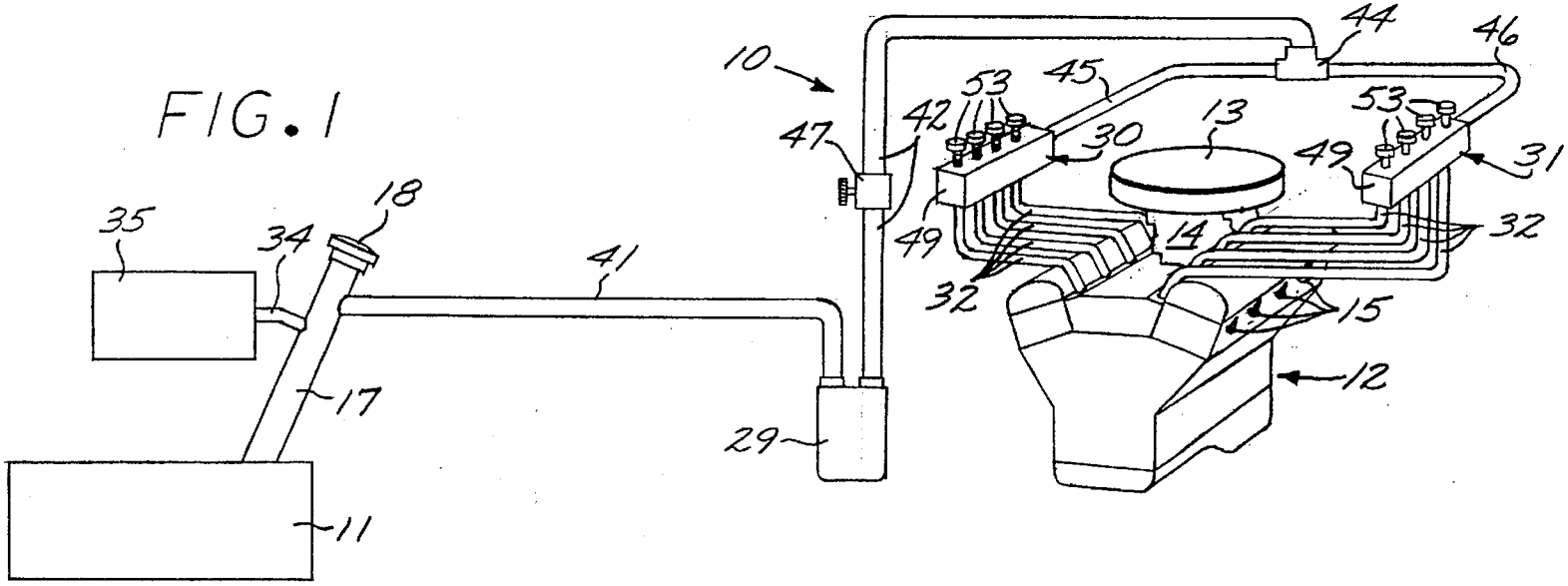
FIG. 1 is a schematic diagram of a gas-saving apparatus embodying the present invention shown with parts of a gasoline-powered automobile engine.

As shown in the drawings for purposes of illustration, the invention is incorporated in a gas-saving apparatus, indicated generally by the reference number 10 in FIG. 1, for supplying a fuel-air mixture from a gas tank 11 to a gasoline-powered internal combustion engine 12 of the piston-and-cylinder type, herein shown as an eight-cylinder "V-8" engine having an air cleaner 13, a carburetor 14 and spark plugs shown generally at 15. The gas tank has an upright fill pipe 17 with an open upper end that is accessible from outside the vehicle and normally is closed and sealed by a cap 18.

In piston-and-cylinder engines, each of the cylinders 19 (see FIG. 3) houses a piston 20 and is closed at one end by a head 21 which cooperates with the cylinder and the piston in defining a combustion chamber 22. An intake valve 23 normally closes intake port 25 but opens to permit the flow of the fuel-air mixture into the chamber when the intake port 25 is opened. An exhaust valve (not shown) is provided for the flow of combustion products out of the chamber when the exhaust valve is opened, all in a conventional manner.

The conventional fuel supply system uses the carburetor 14 to draw gasoline from the gas tank 11 into an air stream flowing to the combustion chambers 22 during the intake ("down") strokes of the pistons 20, to be exploded by the spark plugs 15 in the combustion chambers after being compressed during the "up" or compression strokes of the pistons. Only the parts of the engine 12 that are important for an understanding of the invention are shown in the drawings, the other parts being well known and conventional in construction and operation.

In accordance with the present invention, air is supplied to the "ullage" space 26 (FIG. 2) in the gas tank 11 above the level 27 of the body of liquid fuel 28, and an air-and-gasoline vapor mixture is drawn out of the ullage space and through a safety reservoir in the form of a cannister 29 (FIG. 1) to valving for dividing the vapor mixture into individual flows and delivering the flows directly to the intake valves of the respective cylinders 19. Herein, the valving constitutes two "gang" valve assemblies 30 and 31, each of which serves four of the eight cylinders through connecting conduits 32 and nozzle tubes 33 (FIG. 3). This system thus provides direct connections between the ullage space 26 and the combustion chambers 22 of the cylinders 19, by-passing the carburetor 14 of the vehicle, and by-passing the intake manifold.

Figure 2:
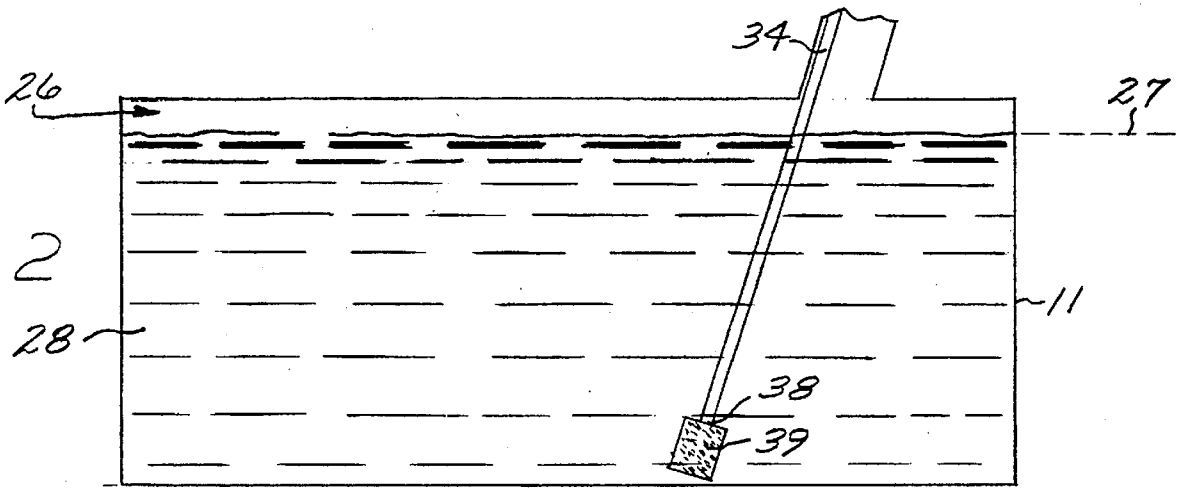
FIG. 2 is an enlarged cross-sectional view taken in a vertical plane through the gas tank shown in FIG. 1, with an aerator in the gas tank.
Figure 3:
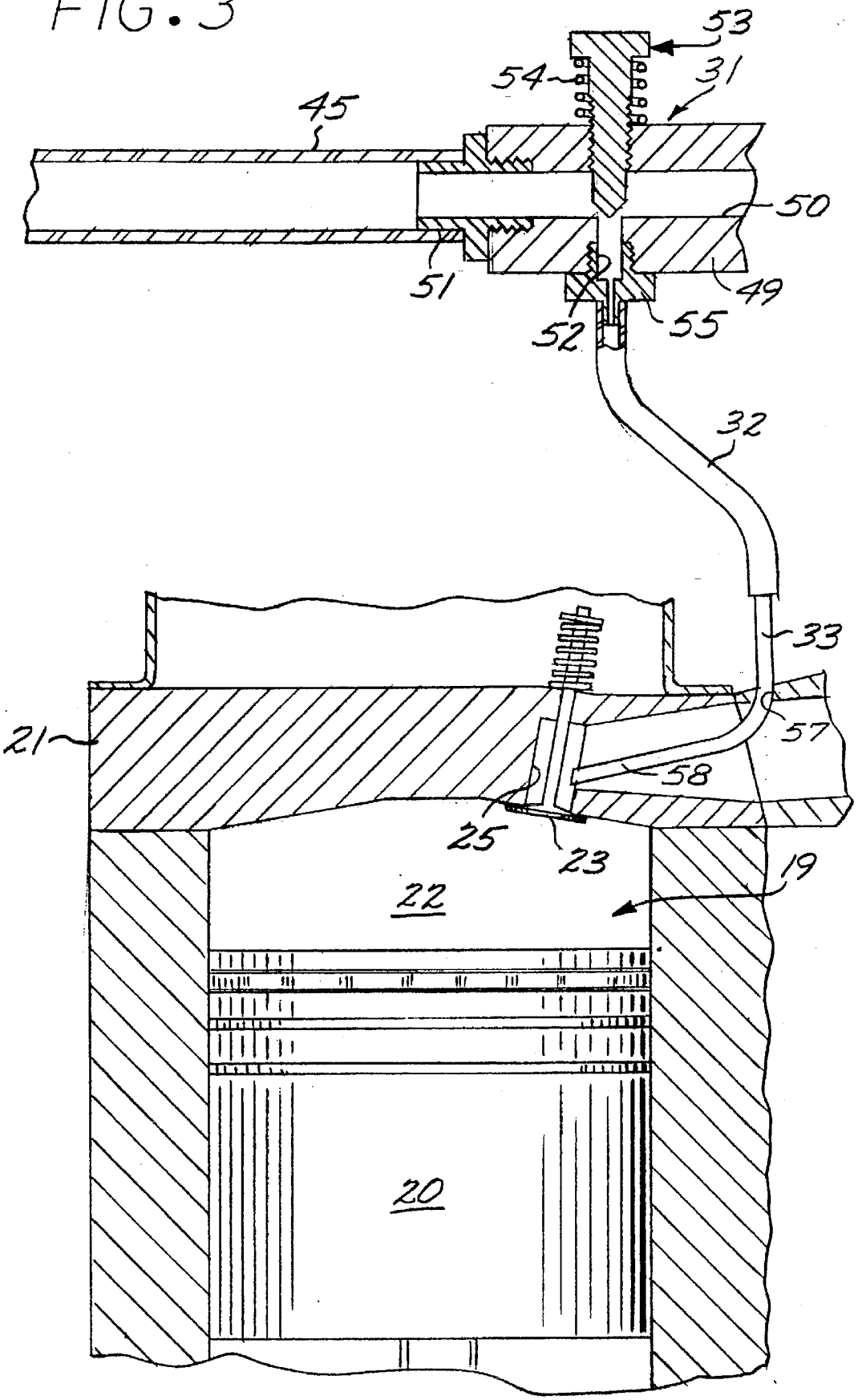
FIG. 3 is an enlarged fragmentary cross-sectional view taken through the valving and one of the cylinders of the automobile engine shown in FIG. 1.

More specifically, as shown in FIGS. 1 and 2, a constant supply of air is provided to the ullage space 26 through a vent pipe 34 and an air filter 35 that is open to outside air. The vent pipe extends into the fill pipe 17, at a level above the gas tank 11, and extends downward through the fill pipe to a lower end 38 near the bottom of the tank. On the lower end of the vent pipe is an aerator 39 through which air is admitted into the tank.

In normal operation, air will be drawn into the gas tank by the suction created by the cylinders 19, and will bubble up to the ullage space 26 through the gasoline 28 in the tank 11. The natural vaporization of the gasoline, augmented by the "sloshing" movement of the body of gasoline in the tank, produces a high concentration of gasoline vapor in the ullage space, including the interior of the fill pipe 17. It is important for proper operation that the gas tank be filled only to a predetermined maximum level, as shown at 27, below the top of the tank, leaving a substantial space for the ullage.

It is to be understood that the carburetor 14 should be rendered in operational during use of the apparatus of the invention, except that the conventional accelerator pump (not shown) of the carburetor will remain operational to initiate operation, creating the vacuum that will draw the air-gasoline vapor mixture from the ullage space 26 and to the engine 12. Disabling of the carburetor may be accomplished in various ways, but most simply by closing the air and fuel jets in the carburetor. This leaves the accelerator pump operational, because its output is independent of the air and fuel jets.

As shown in FIG. 1, the cannister 29 is disposed between the engine 12 and the gasoline tank 11, preferably inside the engine compartment (not shown), and is connected to the engine by a fuel supply line having a first section 41 that opens at one end into the fill pipe 17 and at the other end into the upper portion of the cannister 29 through the top thereof. A continuation 42 of the fuel supply line extends out of the top of the cannister to carry the air-and-gasoline vapor mixture to the engine 12. This cannister prevents any accidental delivery of liquid gasoline to the engine. The cannister may be a simple fluid-tight container with a capacity of two quarts or less of liquid.

From the cannister 29, the continuation 42 of the fuel supply line leads to a "T" connection 44 that divides the fuel supply flow into two lines 45 and 46, one extending to each of the valve manifolds 30, 31 for delivery to the associated bank of cylinders 19. A control valve 47 preferably is installed in the fuel supply line, herein shown near the exit of the line 42 from the cannister 29, to provide means for adjusting the volume of the flow through the line 42 or to close the line entirely if, for any reason, operation of this fuel supply system is to be stopped. This valve is shown schematically as a manual valve, but may be automatically controlled as well.

Since four cylinders 19 are served by each of the "gang" valve assemblies 30, 31, four supply conduits 32 extend from each valve assembly to the associated cylinders 19, communicating between the valve assembly and the interior of the head 21 of the engine 12. While these valve assemblies may take various forms, the simple form shown in FIGS. 1 and 3 to illustrate the invention comprises a block-like elongated body 49 having a central longitudinal bore 50 into which the line 45 opens through a threaded fitting 51 in one end of the body. Four outlet ports 52 are spaced apart along the bore with four needle valve operators 53 threaded into the body and projecting into the bore in opposed relation with the four ports. A coiled spring 54 is fitted around the stem of each needle-valve operator and is compressed between the body 49 and a head on the operator, thereby holding each operator with its inner end "open" in a selected "open" position relative to its associated port 52. This permits the adjustment of all of the valves to balance the flows to the cylinders 19.

To deliver these flows to the cylinders 19, each valve port 52 communicates with the upper end portion of the cylinder through one of the conduits 32, connected at one end to a fitting 55 threaded into the underside of the body 49 and at the other end to a nozzle tube 33 composed of heat resistant material, such as copper tubing. The tubes are fitted at their outer ends in the conduits 32 and extend through bores 57 into the intake manifold of the head 21, with their inner ends 58 forming outlets positioned close to and bent toward the intake port 25 of the associated cylinder 19. Accordingly, there is a direct fuel supply path from the cannister 29 to the intake port of each of the cylinders and, when the intake valve 23 is in the "open" position, to the combustion chamber 22 of the cylinder.

The result is the very efficient delivery of the air-gasoline vapor mixture directly to the intake port 25 and thence into the combustion chamber 22. This is believed to be very important for accomplishing the advantages of the present invention.

To demonstrate the effectiveness of the invention, the apparatus as above described has been installed in a conventional automobile with a gasoline-powered engine, specifically a 1979 Pontiac "Bonneville" station wagon with an eight-cylinder V-8 engine. It was found that fuel efficiency improved from approximately nine miles per gallon ("mpg") to values in the range of fifteen to twenty-seven mpg, depending upon the specific circumstances of operation, and hydrocarbon emissions were reduced from 200 to 300 parts per million (ppm) to twenty-three ppm, while carbon emissions were reduced from 1.0 to 0.5 percent. The conventional carburetor remained in the vehicle but its air and fuel jets were closed, leaving its accelerator pump operative for use in start-up and to create the vacuum that draws the air-and-gasoline vapor mixture through the cannister 29 to the valves and the engine. The invention provided all of the fuel-air mixture used by the engine 12 except that provided by the accelerator pump, producing the exceptional improvements as described.

The method of the invention will be evident from the foregoing detailed description of the apparatus, with the method steps described as well. In general, the method comprises the steps of providing the elements of the apparatus so as to produce the air-gasoline vapor mixture in the ullage space 27 and to divide the mixture into individual flows and deliver each flow to the combustion chambers of one of the cylinders 19 through a nozzle pipe 33 for discharge close to the intake port 25 of that cylinder. Aeration of the gasoline through the vent pipe 34, passage of the mixture through the cannister 29, balancing of the individual flows with the adjustable valve assemblies 30 and 31 are detailed secondary aspects of the method of the invention.

From the foregoing, it will be seen that the apparatus of the invention is quite simple and inexpensive in construction and operation, and both the method and the apparatus provide a novel approach to the delivery of the air-and-gasoline vapor to the cylinders of a gasoline-powered engine. It also will be evident that, while one particular embodiment of the invention has been illustrated and described in detail, various modifications, changes and additions will become apparent to those skilled in the art.

I claim as my invention:

1. An apparatus for improving the fuel efficiency of an internal combustion engine, said engine having a plurality of cylinders with pistons housed therein, said pistons cooperating with the cylinders to define a plurality of combustion chambers, said engine having an intake valve opening into each of said combustion chambers and an intake port for each intake valve, said engine being operably connected to a vehicle having a gasoline tank with a fill pipe for admitting gasoline into the tank to a predetermined level, comprising:

means for admitting a supply of air into said gasoline tank;

a fuel supply line communicating at one end with said gasoline tank above said predetermined level to receive a flow of air-and-gasoline vapor mixture from the tank;

a safety cannister in said fuel supply line for collecting liquid gasoline from said flow;

valving communicating with said fuel supply line to receive said flow and operable to divide the flow into a plurality of separate flows for said plurality of cylinders; and a plurality of conduits directly connected to said valving to receive said separate flows, said conduits including nozzles positioned adjacent to said intake valves to deliver each of the flows directly to the intake port of the associated intake valve.

2. An apparatus for improving the fuel efficiency of an internal combustion engine, said engine having a plurality of cylinders with pistons housed therein, said pistons cooperating with the cylinders to define a plurality of combustion chambers, said engine having an intake valve opening into each of said combustion chambers and an intake port for each intake valve, said engine being operably connected to a vehicle having a gasoline tank with a fill pipe for admitting gasoline into the tank to a predetermined level, comprising:

means for admitting a supply of air into said gasoline tank;

a fuel supply line communicating at one end with said gasoline tank above said predetermined level to receive a flow of air-and-gasoline vapor mixture from the tank;

valving communicating with said fuel supply line to receive said flow and operable to divide the flow into a plurality of separate flows for said plurality of cylinders; and a plurality of conduits directly connected to said valving to receive said separate flows, said conduits including nozzles positioned adjacent to said intake valves to deliver each of the flows directly to the intake port of the associated intake valve, wherein said valving comprises:

at least one valve body having a main passage for receiving the air-and-gasoline vapor mixture from said supply line, a predetermined number of outlet ports each communicating with said main passage to receive separate flows of the mixture, conduits from the outlet ports to the nozzles, and means for individually adjusting and balancing the flows through the ports.

3. Apparatus for improving the fuel efficiency of a vehicle having a gasoline tank adapted to be filled with gasoline to a predetermined level, and an engine having at least one intake port for receiving an air-and-gasoline vapor mixture to power the vehicle, comprising:

means for admitting air into the gasoline tank to form the air-and-gasoline vapor mixture in the ullage space in the tank above the gasoline;

a fuel supply line communicating at one end with the ullage space to receive the vapor mixture therefrom and having an opposite end for delivering the vapor mixture to the engine, wherein said fuel supply line has a safety cannister therein for collecting liquid gasoline from said vapor mixture; and valve assembly means communicating with said opposite end of the fuel supply line to receive the vapor mixture therefrom and deliver the same to the engine, including a conduit terminating in an outlet adjacent to the intake port to deliver the mixture directly to the intake port.

4. Apparatus for improving the fuel efficiency of a vehicle having a gasoline tank adapted to be filled with gasoline to a predetermined level, and an engine having at least one intake port for receiving an air-and-gasoline vapor mixture to power the vehicle, comprising:

means for admitting air into the gasoline tank to form the air-and-gasoline vapor mixture in the ullage space in the tank above the gasoline;

a fuel supply line communicating at one end with the ullage space to receive the vapor mixture therefrom and having an opposite end for delivering the vapor mixture to the engine; and valve assembly means communicating with said opposite end of the fuel supply line to receive the vapor mixture therefrom and deliver the same to the engine, including a conduit terminating in an outlet adjacent to the intake port to deliver the mixture directly to the intake port;

wherein the engine is of the type having a plurality of cylinders each having an intake valve including an intake port, and wherein said valve assembly means comprises valving for receiving the vapor mixture from the fuel supply line and dividing the mixture into a plurality of flows, one for each of the intake ports, and a plurality of conduits each terminating in a nozzle for directing the flow into the intake port of the associated cylinder;

further including adjustable valves in said valving for balancing the flows to said conduits.

5. A method for increasing the fuel efficiency of an engine supplied with gasoline from a gasoline tank and having a plurality of cylinders each having an intake valve with an intake port, comprising the steps of:

supplying air and gasoline to the tank and forming an air-and-gasoline vapor mixture in the tank above the gasoline therein;

withdrawing the vapor mixture from the tank and carrying the mixture to the engine;

dividing the vapor mixture into a plurality of flows, one for each cylinder;

balancing the flows to each of said cylinders; and delivering the flows to the cylinders by releasing the flows close to the intake ports to be drawn directly therein.

6. An apparatus, comprising:

a vehicle;

a gasoline tank with a fill pipe for admitting gasoline into the tank to a predetermined level in said vehicle;

an internal combustion engine operably connected to said vehicle, said engine having a plurality of cylinders with pistons housed therein, said pistons cooperating with the cylinders to define a plurality of combustion chambers, said engine having an intake valve opening into each of said combustion chambers and an intake port for each intake valve;

a vent pipe for admitting a supply of air into said gasoline tank;

a fuel supply line communicating at one end with said gasoline tank above said predetermined level to receive a flow of air-and-gasoline vapor mixture from the tank;

a safety cannister in said fuel supply line for collecting liquid gasoline from said flow;

valving communicating with said fuel supply line to receive said flow and operable to divide the flow into a plurality of separate flows for said plurality of cylinders; and a plurality of conduits directly connected to said valving to receive said separate flows, said conduits including nozzles positioned adjacent to said intake valves to deliver each of the flows directly to the intake port of the associated intake valve.

7. Apparatus as defined in claim 1 wherein said means for admitting air into said tank comprises a vent pipe communicating with the interior of said tank from the outside thereof.

8. Apparatus as defined in claim 7 wherein said vent pipe extends into said tank and has a lower end near the bottom of the tank.

9. Apparatus as defined in claim 8 further including an aerator on said vent pipe disposed in said tank below said predetermined level so as to be immersed in the gasoline therein.

10. Apparatus as defined in claim 1 wherein said cannister is a liquid container having a top with an inlet and an outlet for the fuel supply line.

11. Apparatus as defined in claim 2 wherein said adjusting and balancing means comprise adjustable needle valves for said ports.

12. Apparatus as defined in claim 2 wherein said nozzles comprise heat-resistant tubes having inner end portions directed toward the intake ports and positioned close to the ports to discharge the air-and-gasoline vapor mixture directly into the intake valve.

13. Apparatus as defined in claim 3 wherein the engine is of the type having a plurality of cylinders each having an intake valve including an intake port, and wherein said valve assembly means comprises valving for receiving the vapor mixture from the fuel supply line and dividing the mixture into a plurality of flows, one for each of the intake ports, and a plurality of conduits each terminating in a nozzle for directing the flow into the intake port of the associated cylinder.

14. Apparatus as defined in claim 13 wherein said conduits include tubes of heat-resistant material and having inner outlet ends positioned close to the intake ports.

15. Apparatus as defined in claim 3 further including a safety cannister in said supply line for collecting liquid gasoline.

16. The method defined in claim 5 wherein the delivering step is performed by conducting the flows into the engine and discharging each flow close to and in the direction of the intake port.

17. An apparatus according to claim 6, further comprising an aerator on said vent pipe disposed in said tank below said predetermined level so as to be immersed in the gasoline therein.

18. An apparatus according to claim 6, wherein said valving comprises:

at least one valve body having a main passage for receiving the air-and-gasoline vapor mixture from said supply line, a predetermined number of outlet ports each communicating with said main passage to receive separate flows of the mixture, conduits from the outlet ports to the nozzles, and means for individually adjusting and balancing the flows through said outlet ports.

19. An apparatus according to claim 6, wherein said nozzles comprise heat-resistant tubes having inner end portions directed toward the intake ports and positioned close to the intake ports to discharge the air-and-gasoline vapor mixture directly into the intake valve.

* * * * *